US006425272B1

(12) United States Patent
Chen

(10) Patent No.: US 6,425,272 B1
(45) Date of Patent: Jul. 30, 2002

(54) PADLOCK WITH ELONGATED SHACKLE BAR

(76) Inventor: Waterson Chen, 8F, No. 428, Wu-Chuan-Nan Rd., Taichung City (TW)

( * ) Notice: Subject to any disclaimer, the term of this patent is extended or adjusted under 35 U.S.C. 154(b) by 0 days.

(21) Appl. No.: 09/533,102

(22) Filed: Mar. 22, 2000

(51) Int. Cl.[7] ..... E05B 67/00
(52) U.S. Cl. ..... 70/34; 70/20; 70/36
(58) Field of Search ..... 70/34, 35, 36, 70/20, 21, 31, 38 A, 52, 53

(56) References Cited

U.S. PATENT DOCUMENTS 4,112,715 A * 9/1978 Uyeda ..... 70/38 A

* cited by examiner

*Primary Examiner*—Yonel Beaulieu

(74) *Attorney, Agent, or Firm*—Liniak, Berenato, Longacre & White

(57) ABSTRACT

A padlock includes an elongated shackle bar, a lock body mounted on a first end portion of the shackle bar, and a lock unit mounted on an opposite second end portion of the shackle bar. The lock body and the lock unit have cross-sections larger than that of the shackle bar. The lock unit includes a tubular lock housing, a key-operable lock core mounted in the lock housing, and a shackle engaging member mounted rotatably in the lock housing. The shackle engaging member has a shackle engaging portion for engaging the second end portion of the shackle bar, and a core engaging portion connected to the shackle engaging portion. The core engaging portion is coupled to the lock core so as to be rotated thereby about an axis of the lock housing between a locking position, in which the shackle engaging portion engages the second end portion of the shackle bar to prevent removal of the shackle bar from the shackle engaging member, and an unlocking position, in which the shackle engaging member is disengaged from the second end portion of the shackle bar to permit removal of the shackle bar from the shackle engaging member.

10 Claims, 9 Drawing Sheets

PADLOCK WITH ELONGATED SHACKLE BAR

BACKGROUND OF THE INVENTION

1. Field of the Invention

The invention relates to a padlock having an elongated shackle bar, more particularly to a padlock which is relatively convenient to operate and which can provide an enhanced anti-theft effect.

2. Description of the Related Art

FIG. 1 illustrates a conventional padlock which includes a lock body 1 and a U-shaped shackle 2. The lock body 1 is mounted with a lock core 3 therein, and is formed with a pair of shackle insert holes 4 for receiving longer and shorter leg portions of the shackle 2. Articles to be locked together are generally provided with lobe members 5 that are formed with lock holes 501. The shackle 2 extends through the lock holes 501 for locking the lobe members 5 to each other. In use, when the padlock is in an unlocking state, the lock body 1 should be turned about an axis of the longer leg portion to move the shorter leg portion away from the lock body 1 so as to permit extension of the shorter leg portion through the lock holes 501. After the shorter leg portion is extended through the lock holes 501 in the lobe members 5, the lock body 1 should be turned in an opposite direction to align the shorter leg portion with the corresponding shackle insert hole 4 and to permit the shorter leg portion to extend into the corresponding shackle insert hole 4 for placing the padlock in a locking state. As such, a sufficient space must be provided in the surroundings to permit turning of the lock body 1 for operation of the padlock. The conventional padlock is thus not convenient to operate. Moreover, when the padlock is in the locking state, the shackle 2 is usually exposed from the lobe members 5, and can be damaged with the use of a saw. The anti-theft effect provided by the padlock is not satisfactory.

SUMMARY OF THE INVENTION

Therefore, the object of the present invention is to provide a padlock which is relatively convenient to operate and which can provide an enhanced anti-theft effect.

Accordingly, the padlock of the present invention includes an elongated shackle bar, a lock body and a lock unit. The shackle bar has a first end portion and a second end portion opposite to the first end portion. The lock body is mounted on the first end portion of the shackle bar, and has a cross-section larger than the cross-section of the shackle bar. The lock unit is mounted removably on the second end portion of the shackle bar, and includes a tubular lock housing, a key-operable lock core and a shackle engaging member. The lock housing has a first end distal to the second end portion of the shackle bar and formed with a keyhole adapted for extension of a key into the lock housing, and a second end proximate to the second end portion of the shackle bar. The lock housing has a cross-section larger than the cross-section of the shackle bar. The lock core is mounted in the lock housing adjacent to the keyhole, and has a key operating portion adapted for operation by the key. The shackle engaging member is mounted rotatably in the lock housing adjacent to the second end of the lock housing, and has a shackle engaging portion for engaging the second end portion of the shackle bar, and a core engaging portion connected to the shackle engaging portion. The core engaging portion extends toward the lock core, and is coupled to the key operating portion so as to be rotated thereby about an axis of the lock housing between a locking position, in which the shackle engaging portion engages the second end portion of the shackle bar to prevent removal of the shackle bar from the shackle engaging member and from the lock unit, and an unlocking position, in which the shackle engaging member is disengaged from the second end portion of the shackle bar to permit removal of the shackle bar from the shackle engaging member and from the lock unit.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
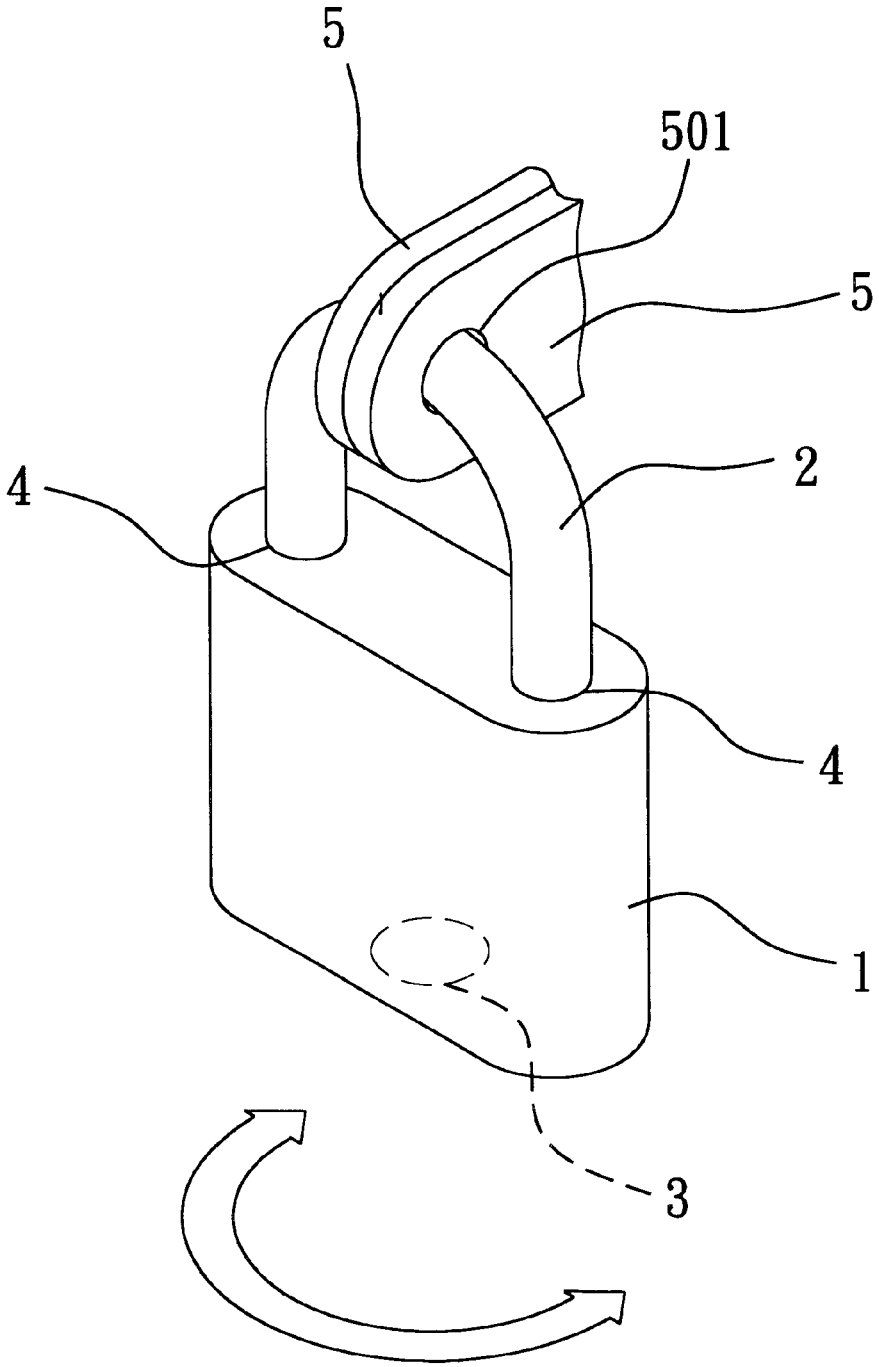
FIG. 1 PRIOR ART
FIG. 1 is a perspective view of a conventional padlock in a state of use.

Before the present invention is described in greater detail, it should be noted that like elements are denoted by the same reference numerals throughout the disclosure.

Figure 2:
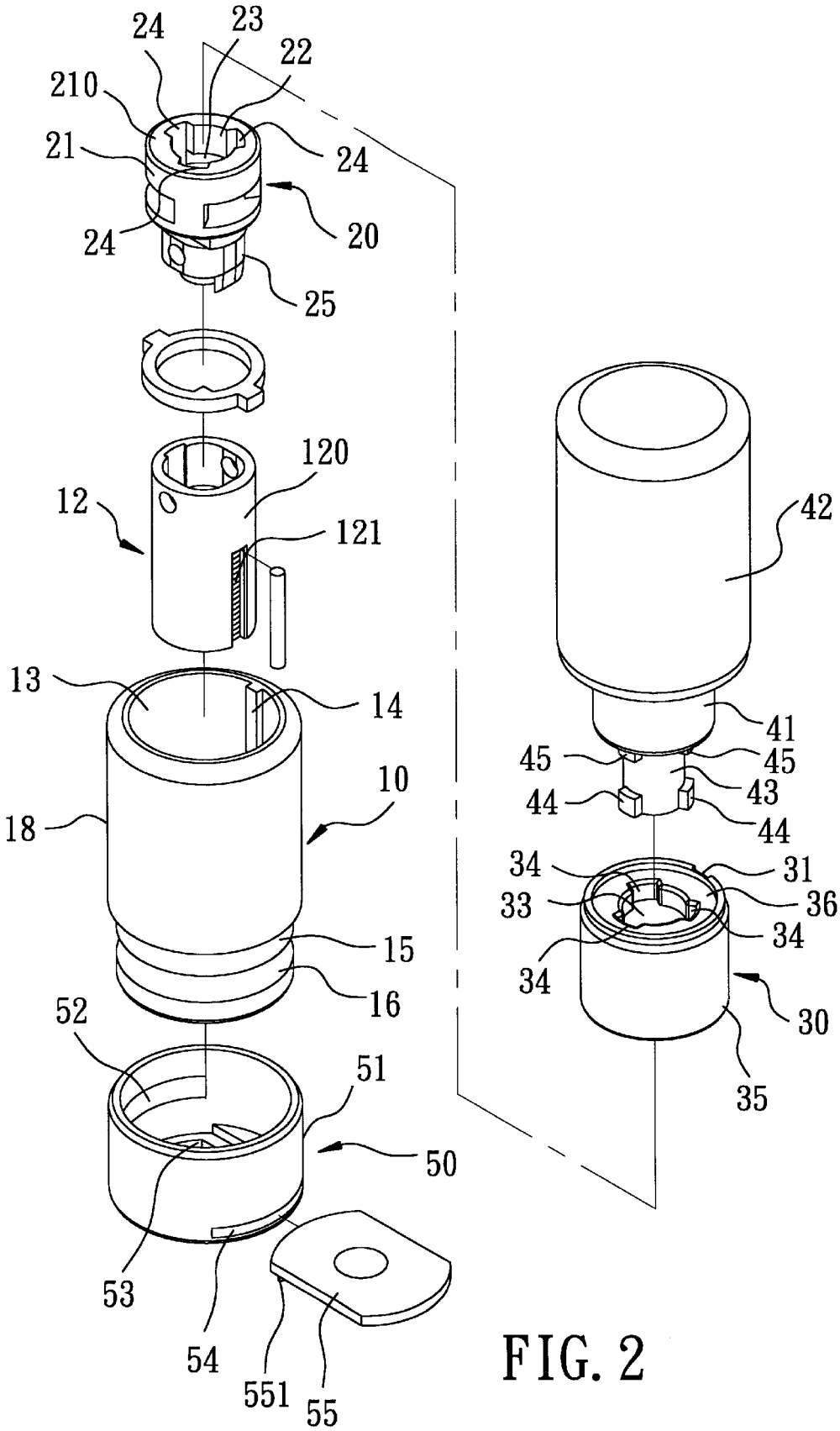
FIG. 2 is an exploded perspective view of a preferred embodiment of the padlock of the present invention.
Figure 5:
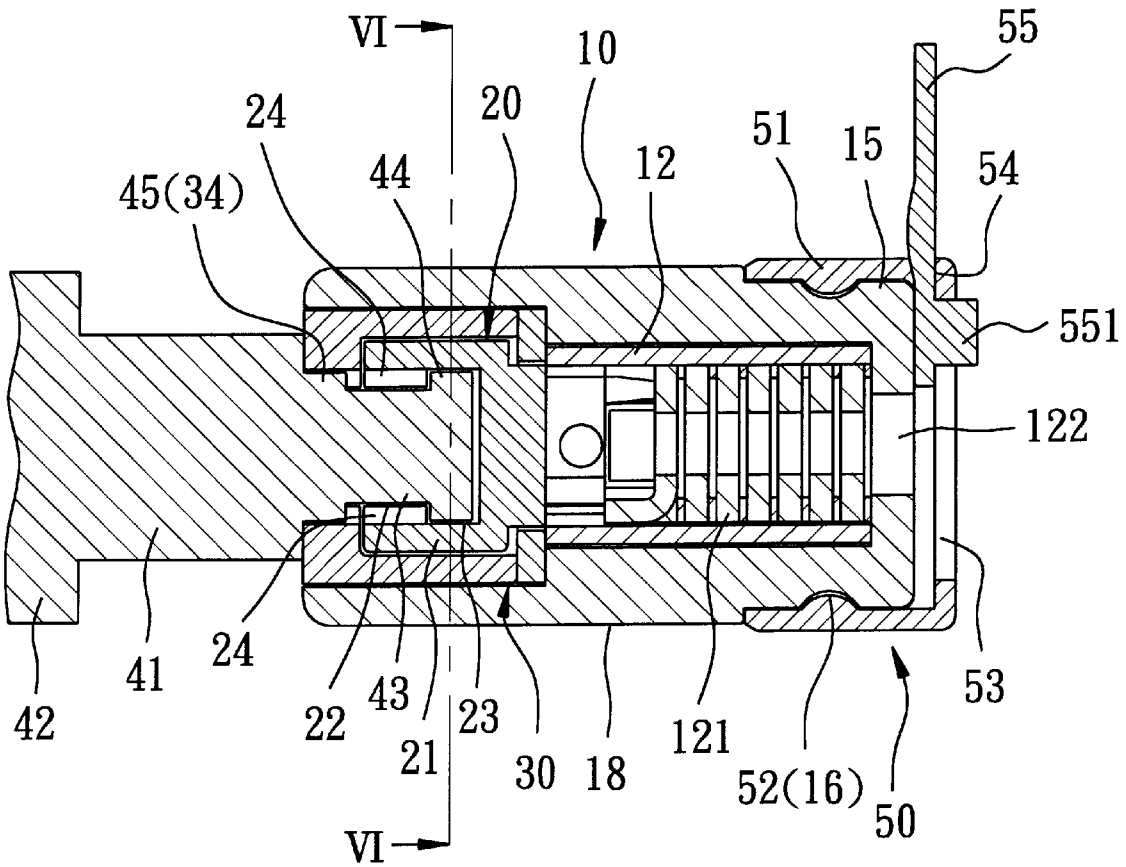
FIG. 5 is a longitudinal sectional view of the preferred embodiment in an unlocking state.

Referring to FIGS. 2 and 5, a preferred embodiment of the padlock of the present invention is shown to include an elongated cylindrical shackle bar 41, a lock body 42 fixed to a first end portion of the shackle bar 41, and a lock unit 10 mounted removably on a narrower second end portion 43 of the shackle bar 41 opposite to the first end portion. The lock body 42 is formed as a cylinder with a cross-section larger than that of the shackle bar 41.

The second end portion 43 of the shackle bar 41 is formed with three radial engaging projections 44 which are angularly displaced from one another, and three radial positioning projections 45 that are angularly displaced from one another. The engaging projections 44 are formed adjacent to an end face of the second end portion 43, and are axially displaced from and are aligned with the positioning projections 45, respectively.

The lock unit 10 is shown to include a positioning member 30, a shackle engaging member 20, a cylindrical lock core 12, a tubular lock housing 18, and a dust cover unit 50.

The lock housing 18 has an open first end 15 distal to the second end portion 43 of the shackle bar 41, and an open second end 13 proximate to the second end portion 43 of the shackle bar 41. The first end 15 is formed with an axial keyhole 122 and an annular peripheral groove 16 therearound. The lock housing 18 has an inner surface that is formed with an axially extending rib 14 adjacent to the second end 13.

The lock core 12 is received in the lock housing 18 adjacent to the keyhole 122. The lock core 12 includes a tubular shell 120 and a stack of locking plates 121 which are received in the shell 120 and which constitute a key operating portion adapted for operation by a corresponding key (not shown) that is inserted into the lock core 12 via the keyhole 122.

The shackle engaging member 20 is received rotatably in the lock housing 18 adjacent to the second end 13. The shackle engaging member 20 has a cylindrical core engaging portion 25 extending into the shell 120 of the lock core 12 and coupled to the locking plates 121 so as to be rotated thereby when the key is operated, and a shackle engaging portion 21 connected to the core engaging portion 25. The shackle engaging portion 21 is tubular in shape, and has an inner periphery that defines an axial shackle hole 22 and that is formed with an annular groove 23 around the shackle hole 22. The inner periphery of the shackle engaging portion 21 is further formed with three guiding slots 24 that extend axially from an end face 210 of the shackle engaging portion 21 to the annular groove 23 for communicating with the annular groove 23 and that are angularly displaced from one another.

The positioning member 30 is mounted in the lock housing 18 at the open second end 13. The positioning member 30 has a tubular sleeve portion 35 disposed around the shackle engaging portion 21 of the shackle engaging member 20, and an end wall 36 formed on one end of the sleeve portion 35 and disposed adjacent to the end face 210 of the shackle engaging portion 21. The end wall 36 is formed with a positioning hole 33 aligned with the shackle hole 22 in the shackle engaging member 20, and three positioning grooves 34 that extend radially and outwardly from the positioning hole 33. The sleeve portion 35 has an outer surface formed with an axially extending groove 31 which engages the rib 14 of the lock housing 18 to prevent relative rotation between the positioning member 30 and the lock housing 18. The second end portion 43 of the shackle bar 41 is extendible into the shackle hole 22 in the shackle engaging member 20 through the positioning hole 33. During extension of the second end portion 43 of the shackle bar 41 into the shackle hole 22, the engaging projections 44 are slidable along the guiding slots 24 for extension into the annular groove 23, and the positioning projections 45 engage the positioning grooves 34 in the positioning member 30, respectively, to prevent relative rotation between the shackle bar 41 and the positioning member 30. The core engaging portion 25 is actuated by the locking plates 121 when the key is operated so as to rotate the shackle engaging portion 21 about the axis of the lock housing 18 between an unlocking position shown in FIGS. 5 and 6, in which the guiding slots 24 are aligned with the engaging projections 44 to permit sliding of the engaging projections 44 along the guiding slots 24 and removal of the second end portion 43 of the shackle bar 41 from the shackle engaging portion 21, and a locking position shown in FIGS. 7 and 8, in which the guiding slots 24 are misaligned with the engaging projections 44 to retain the engaging projections 44 in the annular groove 23 so as to prevent removal of the second end portion 43 of the shackle bar 41 from the shackle engaging member 20.

The dust cover unit 50 includes a cover seat 51 and a dust cover plate 55 retained at the cover seat 51. The cover seat 51 has a tubular sleeve portion which is sleeved around the first end 15 of the lock housing 18 and which has an inner surface formed with a pair of retaining projections 52 (only one is shown) that engage the peripheral groove 16 in the first end 15 of the lock housing 18 for retaining the cover seat 51 at the first end 15 of the lock housing 18. The sleeve portion is further formed with a circumferential slot 54 adjacent to an end wall, which is formed with a key opening 53 that is aligned with the key hole 122 in the lock housing 18. The cover plate 55 is retained movably in the slot 54, and is formed with a gripping projection 551 for gripping by fingers of a user so as to permit operation of the cover plate 55 for selectively covering the key opening 53 to prevent entry of dust into the keyhole 22.

Figure 3:
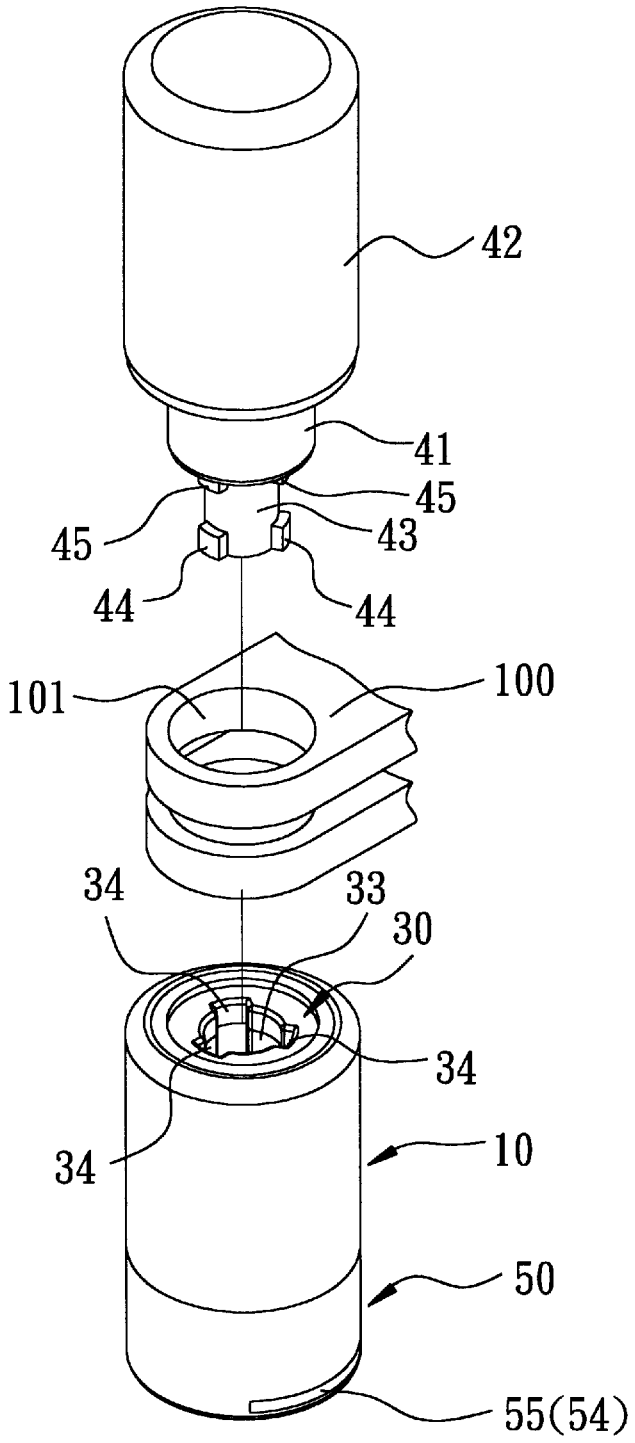
FIG. 3 is a perspective view illustrating how the preferred embodiment is used.
Figure 4:
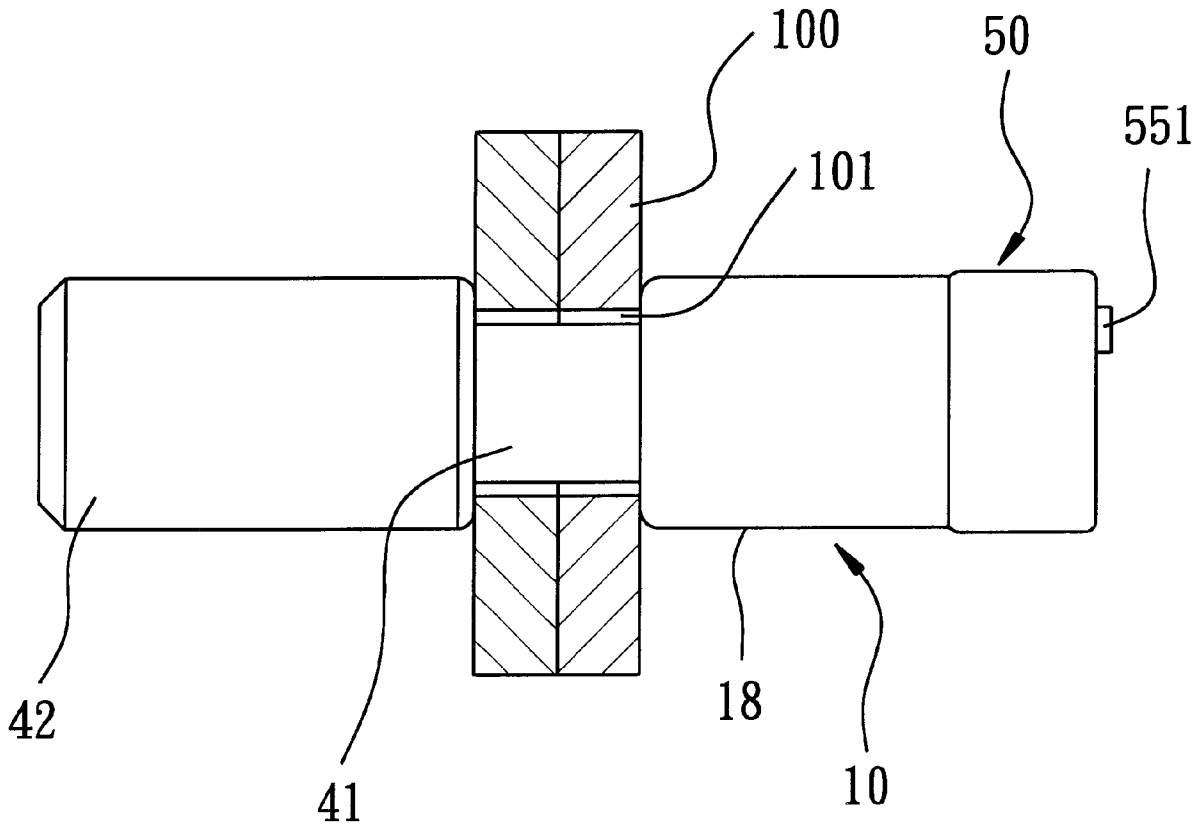
FIG. 4 is a schematic partly sectional view illustrating the preferred embodiment in a state of use.
Figure 6:
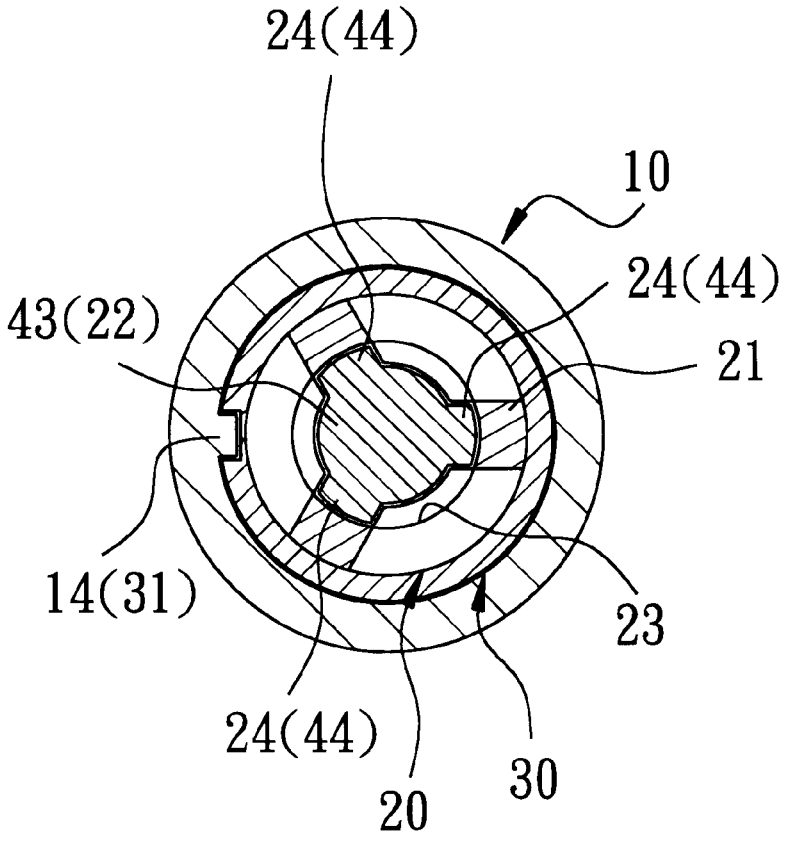
FIG. 6 is a cross-sectional view of the preferred embodiment in the unlocking state, taken along line VI—VI in FIG. 5.
Figure 7:
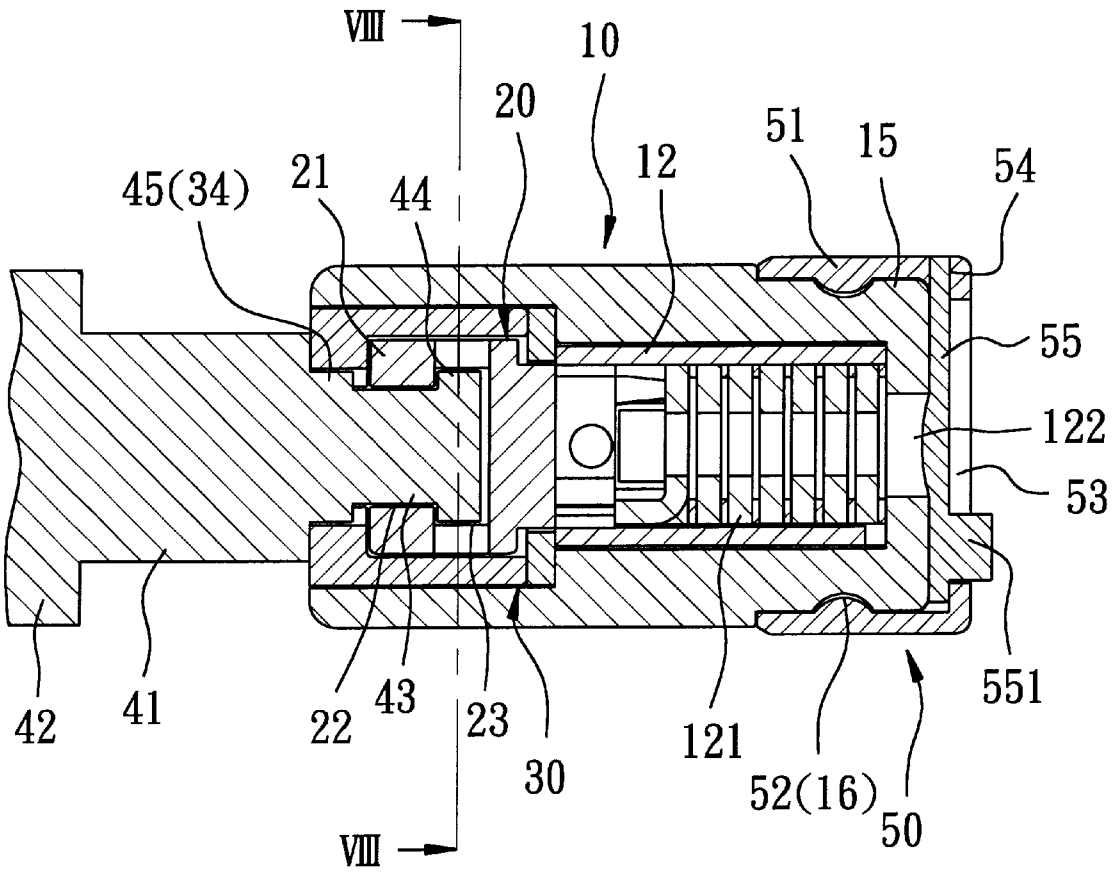
FIG. 7 is a longitudinal sectional view of the preferred embodiment in a locking state.
Figure 8:
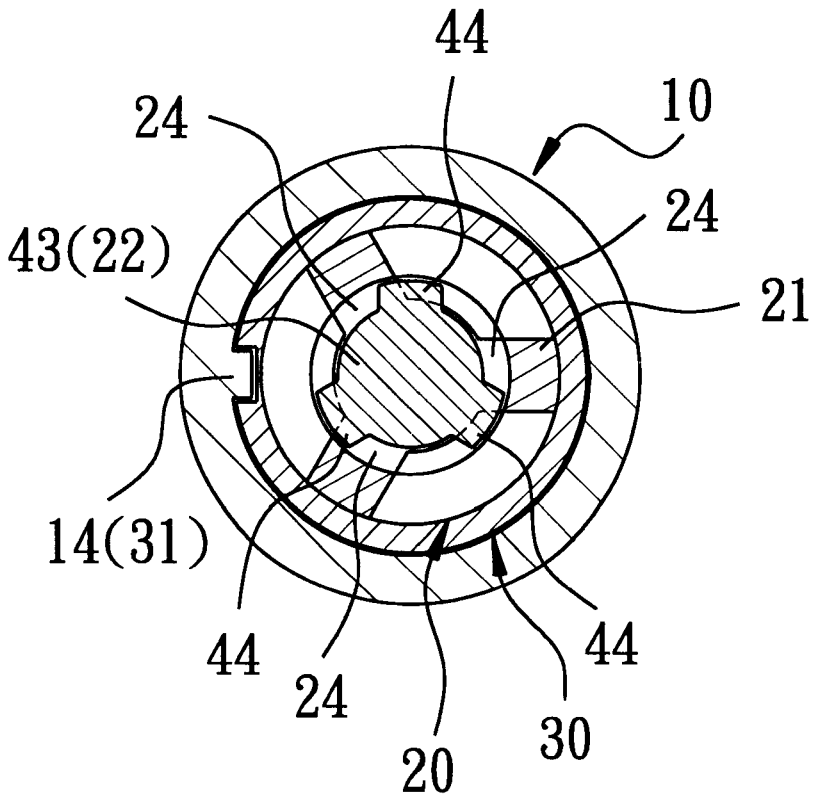
FIG. 8 is a cross-sectional view of the preferred embodiment in the locking state, taken along line VIII—VIII in FIG. 7.

Referring to FIGS. 3 and 4, when the padlock of the preferred embodiment is used for locking together lobe members 100 of two articles, the shackle bar 41 is extended through lock holes 101 in the lobe members 100, and is then inserted into the shackle hole 22 in the shackle engaging member 20 via the positioning hole 33 in the positioning member 30 under the state that the shackle engaging member 20 is in the unlocking position shown in FIGS. 5 and 6. The lobe members 100 are thus disposed between the lock body 42 and the lock unit 10. Thereafter, by operating the key to rotate the shackle engaging member 20 to the locking position, in which the guiding slots 24 are misaligned with the engaging projections 44 on the second end portion 43 of the shackle bar 41, as shown in FIGS. 7 and 8, the shackle bar 41 is locked to the lock unit 10. As the cross-section of the lock body 42 and the cross-section of the lock housing 18 of the lock unit 10 are larger than the cross-section of the shackle bar 41, the lobe members 100 can be retained between the lock body 42 and the lock unit 10, as shown in FIG. 4. Preferably, the shackle bar 41 is designed to have a length sufficient to clamp the lobe members 100 between the lock body 42 and the lock unit 10 and to conceal the shackle bar 41 within the lock holes 101 in the lobe members 100 so as to prevent damage to the shackle bar 41 by a saw tool. As the positioning projections 45 on the second end portion 43 of the shackle bar 41 engage the positioning grooves 34 in the positioning member 30, relative rotation between the shackle bar 41 and the lock unit 10 is prevented so as to prevent disengagement of the shackle bar 41 from the lock unit 10. When it is desired to unlock the lock unit 10 from the shackle bar 41 for removal of the shackle bar 41 from the lobe members 100, the key is operated once again to rotate the shackle engaging member 20 to the unlocking position, in which the guiding slots 24 are aligned with the engaging projections 44, respectively, to permit movement of the shackle bar 41 in the axial direction of the lock unit 10 for removal from the lock unit 10.

Figure 9:
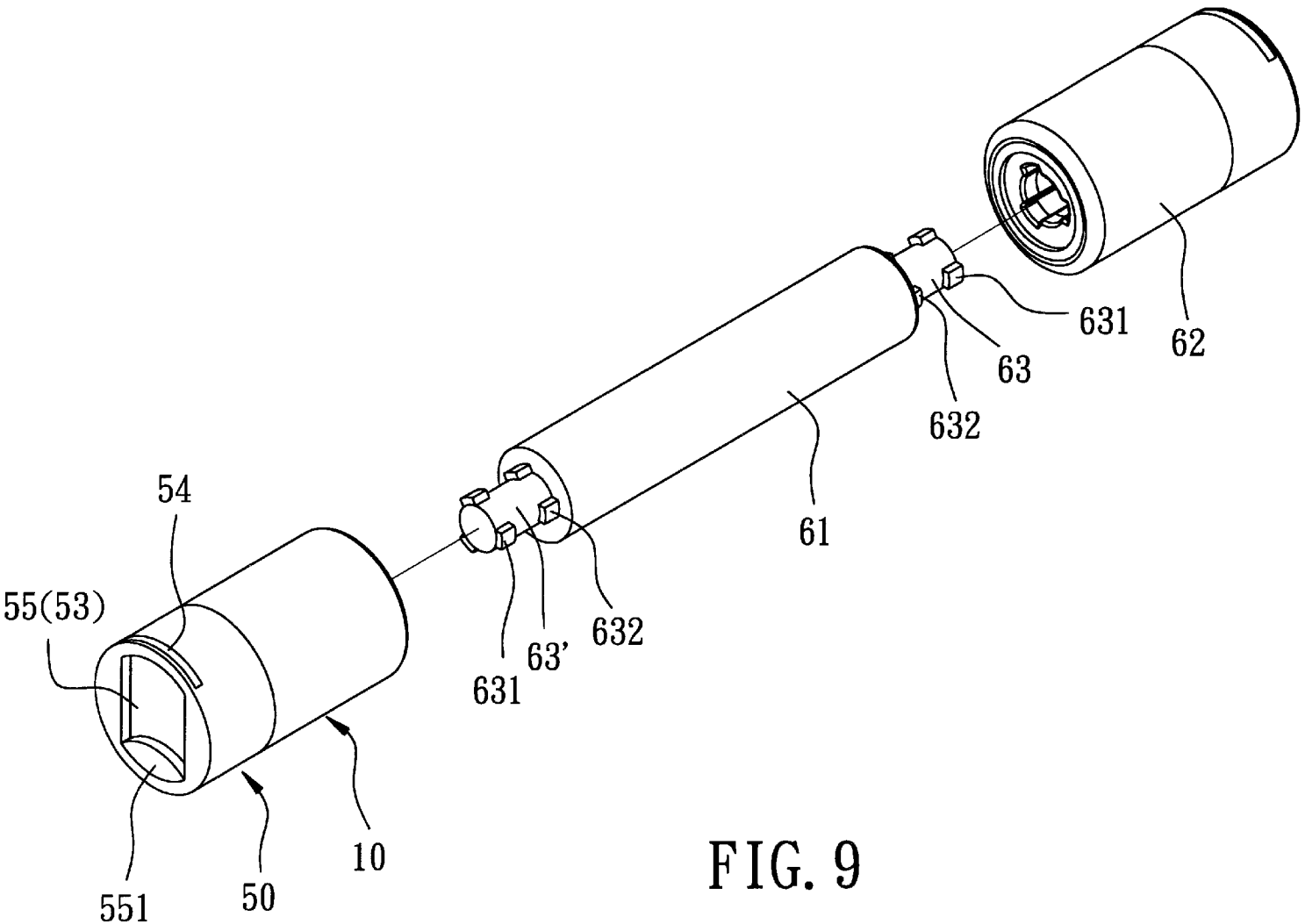
FIG. 9 is a perspective view of another preferred embodiment of the padlock of the present invention.

FIG. 9 illustrates another preferred embodiment of the present invention. The padlock of this embodiment is shown to include an elongated and cylindrical shackle bar 61 with opposite first and second end portions 63, 63', a lock body 62 mounted removably on the first end portion 63, and a lock unit 10 mounted removably on the second end portion 63'. Each of the first and second end portions 63, 63' is formed with three angularly spaced positioning projections 632 and three angularly spaced engaging projections 631 that are aligned respectively with the positioning projections 632. The lock body 62 has a structure identical to that of the lock unit 10, and incorporates locking means operable by a corresponding key (not shown) for locking to and unlocking from the first end portion 63 of the shackle bar 61 in a manner identical to that of the lock unit 10.

It has thus been shown that, during operation of the padlock of the present invention, the shackle bar 41 moves along the axis of the lock housing 18 toward and away from the lock housing 18 to permit sleeving of the lobe members 100 thereon. A space in the surroundings to permit turning of the lock housing 18 is not required. The padlock of the present invention thus provides added convenience during operation thereof. In addition, as the shackle bar 41, 61 is formed as an elongated cylinder, the shackle bar 41, 61 can be designed to have a length that permits clamping of the lobe members 100 between the lock body 42, 62 and the lock unit 10, and that permits the shackle bar 41 to be concealed by the lobe members 100 when the padlock is in the locking state. An enhanced anti-theft effect can thus be attained.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. A padlock comprising:

an elongated shackle bar extending along a straight longitudinal axis, said shackle bar having a first end portion and a second end portion opposite to said first end portion along said straight longitudinal axis;

a lock body mounted on said first end portion of said shackle bar, said lock body having a cross-section larger than cross-section of said shackle bar; and a lock unit mounted removably on said second end portion of said shackle bar and spaced apart from said lock body along said longitudinal axis, said lock unit including:

a tubular lock housing having a first end distal to said second end portion of said shackle bar and formed with a keyhole adapted for extension of a key into said lock housing, and a second end proximate to said second end portion of said shackle bar, said lock housing having a cross-section larger than the cross-section of said shackle bar, a key-operable lock core mounted in said lock housing adjacent to said keyhole, said lock core having a key operating portion adapted for operation by the key, and a shackle engaging member mounted rotatably in said lock housing adjacent to said second end of said lock housing, said shackle engaging member having a shackle engaging portion for engaging said second end portion of said shackle bar, and a core engaging portion connected to said shackle engaging portion, said core engaging portion extending toward said lock core and being coupled to said key operating portion so as to be rotated thereby about an axis of said lock housing between a locking position, in which said shackle engaging portion engages said second end portion of said shackle bar to prevent removal of said shackle bar from said shackle engaging member and from said lock unit, and an unlocking position, in which said shackle engaging member is disengaged from said second end portion of said shackle bar to permit removal of said shackle bar from said shackle engaging member and from said lock unit.

2. The padlock according to claim 1, wherein said lock body is fixed to said first end portion of said shackle bar.

3. The padlock according to claim 1, wherein said shackle engaging portion of said shackle engaging member is tubular in shape, said shackle engaging portion having an end face and an inner periphery that defines an axial shackle hole and that is formed with an annular groove around said shackle hole, said inner periphery being further formed with at least one guiding slot which extends axially from said end face to said annular groove, said second end portion of said shackle bar being extendible into said shackle hole and being formed with at least one radial engaging projection which is slidable along said guiding slot for extension into said annular groove, said guiding slot being aligned with said engaging projection to permit movement of said engaging projection along said guiding slot and removal of said second end portion of said shackle bar from said shackle engaging portion of said shackle engaging member when said shackle engaging member is rotated to the unlocking position, said guiding slot being misaligned with said engaging projection to prevent removal of said engaging projection from said annular groove so as to prevent removal of said second end portion of said shackle bar from said shackle engaging member when said shackle engaging member is rotated to the locking position.

4. The padlock according to claim 3, wherein said lock unit further includes a positioning member mounted non-rotatably on said second end of said lock housing, said positioning member having a tubular sleeve portion extending into said second end of said lock housing and disposed around said shackle engaging member, and an end wall formed on one end of said sleeve portion, said end wall being formed with a positioning hole aligned with said shackle hole in said shackle engaging member and at least one radial positioning groove that extends radially and outwardly from said positioning hole, said second end portion of said shackle bar being formed with at least one radial positioning projection which engages said positioning groove when said shackle bar is inserted into said shackle hole through said positioning hole, thereby preventing relative rotation between said shackle bar and said lock housing.

5. The padlock according to claim 4, wherein said sleeve portion of said positioning member has an outer wall surface formed with an axially extending slot, said lock housing having an inner surface formed with an axially extending rib which engages said axially extending slot to prevent relative rotation between said positioning member and said lock housing.

6. The padlock according to claim 4, wherein said at least one positioning projection on said second end portion of said shackle bar is aligned with said at least one engaging projection in an axial direction.

7. The padlock according to claim 4, wherein said second end portion of said shackle bar is formed with three of said positioning projections which are angularly spaced apart from one another, and three of said engaging projections that are angularly spaced apart from one another and that are aligned respectively with said positioning projections.

8. The padlock according to claim 1, wherein said lock body is mounted removably on said first end portion of said shackle bar and incorporates locking means for locking to and unlocking from said first end portion of said shackle bar.

9. The padlock according to claim 1, wherein said shackle bar is cylindrical in shape, and said longitudinal axis of said shackle bar are aligned along the axis of said lock housing of said lock unit.

10. A padlock comprising:

a substantially straight shackle bar extending along a axis between a first end portion and a second end portion, a lock body mounted on said first end portion of said shackle bar, said lock body having a cross-section substantially larger than a cross-section of said shackle bar; and a separate lock unit detachably secured to said shackle bar proximate said second end portion of said shackle bar, wherein when said lock unit is detached to said shackle bar, said shackle bar may be manipulated thought a lock hole of a lock lobe without manipulating said lock unit, and when said lock unit is thereafter secured to said shackle bar, said shackle bar remains locked to said lock lobe to provide a locking function.

* * * * *